US009868302B1

(12) United States Patent
Aminpour

(10) Patent No.: US 9,868,302 B1
(45) Date of Patent: Jan. 16, 2018

(54) FLUORESCENT INK PRINTING, CUTTING, AND APPAREL ASSEMBLY

(71) Applicant: Amazon Technologies, Inc., Seattle, WA (US)

(72) Inventor: Rouzbeh Safavi Aminpour, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 15/187,272

(22) Filed: Jun. 20, 2016

(51) Int. Cl.
*B41J 11/70* (2006.01)
*B41J 3/407* (2006.01)

(52) U.S. Cl.
CPC ..... *B41J 11/70* (2013.01); *B41J 3/4078* (2013.01)

(58) Field of Classification Search
None
See application file for complete search history.

(56) References Cited

U.S. PATENT DOCUMENTS

| | | | |
|---|---|---|---|
| 4,178,820 A | 12/1979 | Serber | |
| 5,132,505 A | 7/1992 | Zonneveld et al. | |
| 5,172,326 A | 12/1992 | Campbell, Jr. et al. | |
| 5,254,833 A | 10/1993 | Okiyama | |
| 5,333,111 A | 7/1994 | Chaiken et al. | |
| 5,418,711 A | 5/1995 | Pomerleau et al. | |
| 5,709,506 A | 1/1998 | Beard et al. | |
| 5,791,215 A | 8/1998 | Morrison et al. | |
| 5,806,390 A | 9/1998 | Pomerleau et al. | |
| 5,867,392 A | 2/1999 | Bousquet | |
| 5,975,743 A | 11/1999 | Bercaits | |
| 6,028,320 A * | 2/2000 | Uhling | B41J 11/009 250/458.1 |
| 6,173,211 B1 | 1/2001 | Williams et al. | |
| 6,349,241 B1 | 2/2002 | Peron et al. | |
| 6,502,489 B2 | 1/2003 | Gerent et al. | |

(Continued)

FOREIGN PATENT DOCUMENTS

WO 2016033367 3/2016

OTHER PUBLICATIONS

PCT Patent Application PCT/US17/016802 filed on Feb. 7, 2017, International Search Report and Written Opinion dated May 10, 2017.

(Continued)

*Primary Examiner* — Lisa M Solomon
(74) *Attorney, Agent, or Firm* — Eversheds Sutherland (US) LLP

(57) ABSTRACT

Aspects of fluorescent ink printing, cutting, and apparel assembly are described. In one example, a system includes a textile printer, a textile cutter, and a computing device that arranges panels and develops print features related to textile products. The computing device can assign certain print features to be printed using fluorescent inks. The computing environment can then instruct a textile printer to print textile panels, for example, along with the print features, using the fluorescent inks. Once the panels are printed, ultraviolet (UV) light sources can be used to create a fluorescent reflection from the fluorescent inks. The fluorescent reflection can be captured by image sensors to generate instructions to cut the panels out from the textile sheet. The reflection can also be used as assembly notations for reference by sewing workers or automated sewing systems.

20 Claims, 7 Drawing Sheets

(56) References Cited

U.S. PATENT DOCUMENTS

| | | | |
|---|---|---|---|
| 6,520,057 | B1 | 2/2003 | Steadman |
| 6,807,289 | B2 | 10/2004 | Zink |
| 6,836,694 | B1 | 12/2004 | Podubrin |
| 7,003,370 | B2 | 2/2006 | Rapoza |
| 8,428,767 | B2 | 4/2013 | Tremoureux et al. |
| 8,731,703 | B1 | 5/2014 | Lehrer et al. |
| 8,838,482 | B2 | 9/2014 | Schindler et al. |
| 2005/0065631 | A1 | 3/2005 | Rapoza |
| 2005/0240416 | A1 | 10/2005 | Schindler et al. |
| 2007/0107572 | A1 | 5/2007 | Pommier |
| 2013/0144424 | A1 | 6/2013 | Jarbouai |
| 2013/0261785 | A1 | 10/2013 | Crary et al. |
| 2014/0277663 | A1 | 9/2014 | Gupta et al. |
| 2014/0277683 | A1 | 9/2014 | Gupta et al. |
| 2015/0066189 | A1 | 3/2015 | Mulligan et al. |

OTHER PUBLICATIONS

PCT Patent Application PCT/US17/020334 filed on Mar. 2, 2017, International Search Report and Written Opinion dated Jun. 8, 2017.

U.S. Appl. No. 15/069,855, filed Mar. 14, 2016, Response to Non-Final Office Action dated May 19, 2017.

U.S. Appl. No. 15/069,855, filed Mar. 14, 2016, Non-Final Office Action dated May 19, 2017.

U.S. Appl. No. 14/970,840, filed Dec. 16, 2015, Notice of Allowance dated Jun. 26, 2017.

U.S. Appl. No. 14/970,840, filed Dec. 16, 2015, Response to Office Action dated Feb. 24, 2017.

U.S. Appl. No. 14/970,840, filed Dec. 16, 2015, Final Office Action dated Feb. 24, 2017.

U.S. Appl. No. 14/970,840, filed Dec. 16, 2015, Response to Non-Final Office Action dated Aug. 16, 2016.

U.S. Appl. No. 14/970,840, filed Dec. 16, 2015, Non-Final Office Action dated Aug. 16, 2016.

U.S. Appl. No. 14/970,840, filed Dec. 16, 2015, Notice of Allowance dated Mar. 27, 2017.

U.S. Appl. No. 14/970,874, filed Dec. 16, 2015, Response to Non-Final Office Action dated Aug. 11, 2016.

U.S. Appl. No. 14/970,874, filed Dec. 16, 2015, Non-Final Office Action dated Aug. 11, 2016.

* cited by examiner

FLUORESCENT INK PRINTING, CUTTING, AND APPAREL ASSEMBLY

CROSS-REFERENCE TO RELATED APPLICATIONS

This application is related to U.S. patent application Ser. No. 14/970,874, filed Dec. 16, 2015, titled "On Demand Apparel Manufacturing" ("the '874 application"), U.S. patent application Ser. No. 14/970,840, filed Dec. 16, 2015, titled "On Demand Apparel Panel Cutting" ("the '840 application"), U.S. patent application Ser. No. 15/069,849, filed Mar. 14, 2016, titled "Automated Fabric Picking" ("the '849 application"), U.S. patent application Ser. No. 15/069,855, filed Mar. 14, 2016, titled "Continuous Feed Fabric Cutting" ("the '855 application"), and U.S. patent application Ser. No. 15/069,867, filed Mar. 14, 2016, titled "Organized Assembly Instruction Printing and Referencing" ("the '867 application")(collectively, "the Related Applications"), the entire disclosure of each of the Related Applications are hereby fully incorporated herein by reference.

BACKGROUND

The apparel manufacturing industry relies upon various resources, processes, and equipment to produce finished garments, accessories, footwear, etc. Generally, a process to manufacture a garment includes garment design, fabric production and/or printing, panel cutting, and sewing. Although certain types of automation have been applied to many apparel manufacturing processes, many of the new techniques have not been applicable across all phases of apparel manufacturing. Further, many of the new techniques have attempted to improve old methods, without incorporating or relying upon new advancements in materials science and technology.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Figure 1:
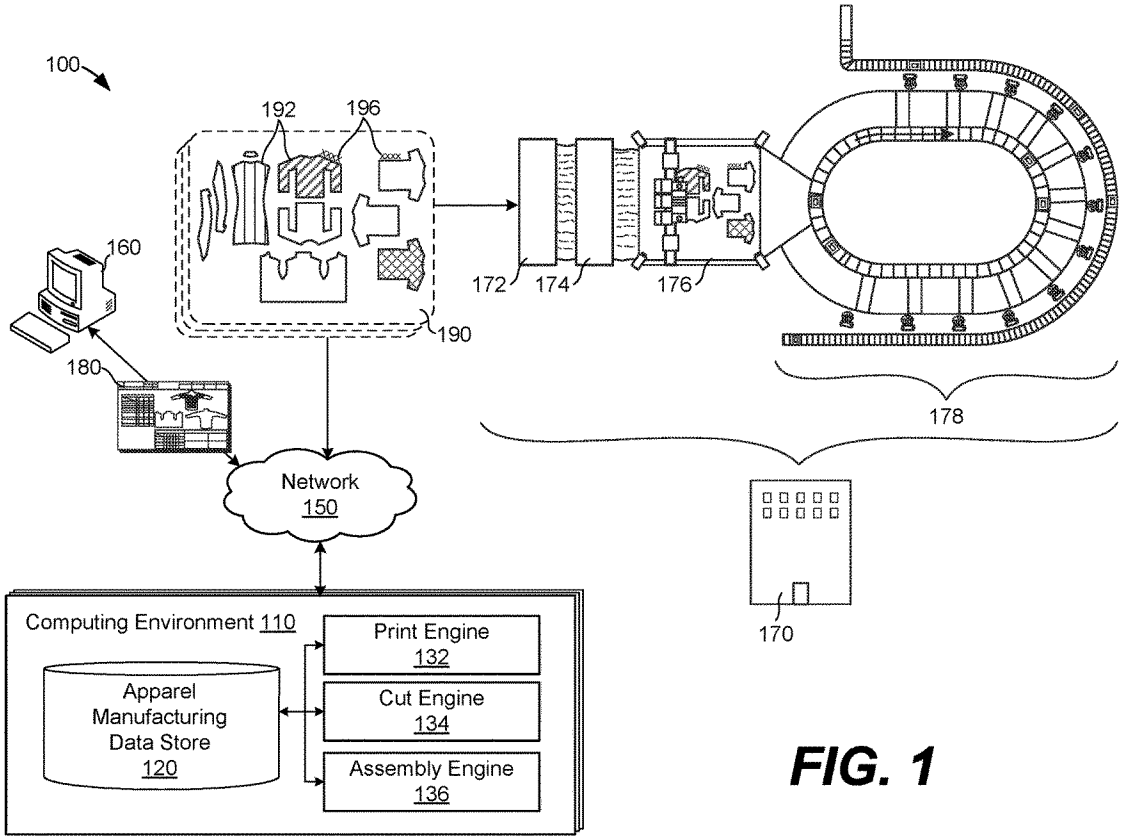
FIG. 1 illustrates a networked environment for fluorescent ink printing, cutting, and apparel assembly according to various embodiments of the present disclosure.

Aspects of fluorescent ink printing, cutting, and apparel assembly are described herein. In one embodiment, a system includes a textile printer, a textile cutter, and a computing environment or device. The textile printer includes various tanks for holding a number of different colors and types of inks or dyes for printing patterns, graphics, notations, and other print features onto textile sheets. The inks can include both a set of fluorescent inks or dyes of various colors and another set of non-fluorescent inks or dyes. In one example, the fluorescent inks can be invisible (except under UV light), washable, protein-based inks, and the non-fluorescent inks can be visible, permanent, non-washable inks. In other cases, the fluorescent inks can include permanent non-protein-based inks, and the non-fluorescent inks can include washable inks. According to the embodiments, the system makes use of both the fluorescent and non-fluorescent inks to help improve various aspects in apparel manufacturing processes.

The computing environment can receive textile product information, such as apparel-related tech packs, including a definition of one or more panels, instructions for the manufacture and assembly of various textile products, and other relevant information. Tech packs and examples of the types of information stored in tech packs are described in the Related Applications. Using the textile product information, the computing environment can identify and arrange panels for the textile products and develop print features related to the textile products. Depending upon the nature or type of the print features, the computing device can assign some of the print features to be printed using various colors of fluorescent inks and other print features to be printed using non-fluorescent inks.

The computing environment can then instruct the textile printer to print the print features onto a textile sheet using a combination of the fluorescent and non-fluorescent inks. Once the print features are printed onto the textile sheet by the textile printer, the panels can be cut out from the textile sheet by a textile cutter. To assist with the cutting, the computing environment can instruct the textile cutter to illuminate one or more ultraviolet (UV) or infrared (IR) light sources, for example, directed toward the textile sheet. When fluorescent inks are used for printing certain print features onto the textile sheet, the fluorescent inks emit a fluorescent reflection in response to the UV or IR light sources. In turn, the fluorescent reflection can be captured by image sensors (e.g., cameras including image sensors) at the textile cutter, and those captured images can be used by the computing device to generate instructions to cut the panels out from the textile sheet.

Once cut out, the panels can be provided to sewing workers or other automated systems for assembly. To assist with the assembly of the textile products, the print features can include a number of assembly notations or other instructions printed on the textile sheet. In some cases, the assembly notations or instructions can be printed by the textile printer using the fluorescent inks. Among others, the assembly notations can include a combination of unique identifiers, fastener notations, stitch location markers, stitch start markers, stitch end markers, and other notations.

Because the fluorescent inks can be invisible when not illuminated using UV or IR light, the assembly notations may not be visible under other light sources. Sewing workers can view the assembly notations by illuminating the fluorescent inks using UV or IR light sources. The sewing workers can then refer to the assembly notations to help determine how textile products should be assembled or finished. Further, because the fluorescent inks can be washable, the assembly notations can be removed by washing the textile products after they are assembled but before or after they are distributed for sale or sold.

Before turning to the figures, it is noted that the embodiments are not limited to the manufacture or assembly of any particular type(s) of textile, fabric, or clothing products from any particular type(s) of materials. Instead, the concepts described herein can be applied to the manufacture of a wide array of products, including clothing or fabric products, accessories (e.g., scarves, gloves, hats, bags, belts, etc.), footwear, bedding, curtains, towels, etc., in a wide variety of materials, including but not limited to paper, plastic, leather, rubber, and other materials. Thus, references to textiles or textile sheets are not intended to be limiting as to the types of materials that can be cut and/or assembled using the concepts described herein.

As an overview, FIG. 1 illustrates a networked environment 100 for fluorescent ink printing, cutting, and apparel assembly. The networked environment 100 includes a computing environment 110, a network 150, and one or more client devices 160. At facility 170, the networked environment 100 also includes a textile printer 172, a textile dryer 174, a textile cutter 176, and a textile production line 178.

The locations of the computing environment 110, the client devices 160, and the facility 170 are representative in FIG. 1, and the embodiments can be organized and/or distributed in other ways than that shown. For example, the computing environment 110 can be geographically located, in part or entirely, at the facility 170. Alternatively, the computing environment 110 can be geographically dislocated from the facility 170 while controlling and/or directing the operation of certain equipment in the facility 170 via the network 150. In either case, the network 150 can facilitate two-way data and control communications between the computing environment 110 and certain equipment in the facility 170.

The computing environment 110 includes an apparel manufacturing data store 120, a print engine 132, a cut engine 134, and an assembly engine 136. In the networked environment 100, the computing environment 110 is configured to direct certain textile printing, cutting, and product assembly processes at the facility 170 through communications with and control of (among other systems) the textile printer 172, textile dryer 174, textile cutter 176, and textile production line 178 via the network 150.

The computing environment 110 is configured to receive instructions for manufacturing textile products, such as products that incorporate textile, paper, plastic, leather, rubber, and/or other materials from the client device 160, by direct input, or in any other suitable way. The instructions can be received in the form of (or along with) tech packs 180, for example. Once received, the orders can be stored in the apparel manufacturing data store 120 for further processing by the computing environment 110. The tech packs 180 can be embodied as various types of digital files, such as job definition format (JDF) or other types of files that define instructions to manufacture one or more textile products at the facility 170, for example, among other facilities.

Based on the instructions for manufacturing textile products, the print engine 132 is configured to generate textile panel templates 190 (or other instructions) including various arrangements of panels 192 for the textile products. The print engine 132 can also instruct the textile printer 172 to print panel outlines for the panels 192, print graphics for the panels 192, assembly notations 196 for the panels 192, and other print features onto textile sheets. Once the print features are printed onto textile sheets, the cut engine 134 is configured to instruct the textile cutter 176 to cut the panels 192 out from the textile sheets. The use of the fluorescent inks on the textile sheets can assist with cutting out the panels 192 as described below.

The assembly engine 136 is configured to generate assembly schemes for manufacturing textile products. Each assembly scheme can include an ordered set of assembly tasks, such as stitching seams, attaching fasteners, hemming sides, etc. Based on the assembly schemes, the assembly engine 136 can also incorporate one or more assembly notations 196 into the textile panel templates 190. The assembly notations 196 can be printed by the textile printer 172 using fluorescent or non-fluorescent inks. Other functional aspects of the print engine 132, cut engine 134, and assembly engine 136 are described in further detail below with reference to FIG. 2.

The textile printer 172 can be embodied as any suitable type of printer for printing on textile fabrics or other materials. Textile printing is related to textile dyeing but, rather than uniformly dyeing a fabric sheet in its entirety, textile printing involves applying one or more colors to only certain parts or areas of a textile sheet, often in sharply defined patterns. In that context, the textile printer 172 may be embodied, for example, as a digital textile printer, digital garment printer, or direct-to-garment printer. The textile printer 172 can use specialized inkjet technologies, for example, to apply ink directly on fabrics. The textile printer 172 can include several tanks that hold different types and colors of ink, including various types or colors of fluorescent and non-fluorescent inks. The structure and operation of the textile printer 172 is described in greater detail below with reference to FIG. 3.

The textile dryer 174 can be embodied as any suitable type of dryer for drying ink printed on textile fabrics or other materials. The textile dryer 174 can include adjustable UV, IR, or heat panels, for example, to dry or cure ink applied by the textile printer 172, as needed. In some embodiments, the textile dryer 174 may not be necessary based on the printing/ink technology used by the textile printer 172. Thus, the textile dryer 174 may be omitted and/or incorporated with the textile printer 172 in some embodiments. The operation of the textile dryer 174 can be controlled by the print engine 132 over the network 150, as needed.

The textile cutter 176 can be embodied as any suitable type of cutter, cutting table, or cutting machine. For cutting and manipulating various types of fabrics and other materials, the textile cutter 176 can include one or more drag knives, wheel knives, lasers, pneumatic and/or electric oscillating cutting knives, lasers, pneumatic and/or electric rotary cutting knives and/or tools, scoring tools, v-cutting (e.g., scissor-type) tools, partout tools, creasing tools, routing and/or engraving tools, and other types of tools. The structure and operation of the textile cutter 176 is described in greater detail below with reference to FIG. 3.

In one embodiment, textile sheets can be fed directly from the textile printer 172 into the textile dryer 174 and, subsequently, the textile cutter 176. In other embodiments, the textile sheets can be manually moved and fed from the textile printer 172, to the textile dryer 174, and to the textile cutter 176.

The textile production line 178 can be embodied as an arrangement of one or more conveyors, totes, sewing or assembly stations, and associated drive and control systems. Once the panels 192 are cut out from the textile sheets by the textile cutter 176, the cut-out panels can be forwarded to the textile production line 178 and routed to one or more sewing or assembly stations.

Figure 2:
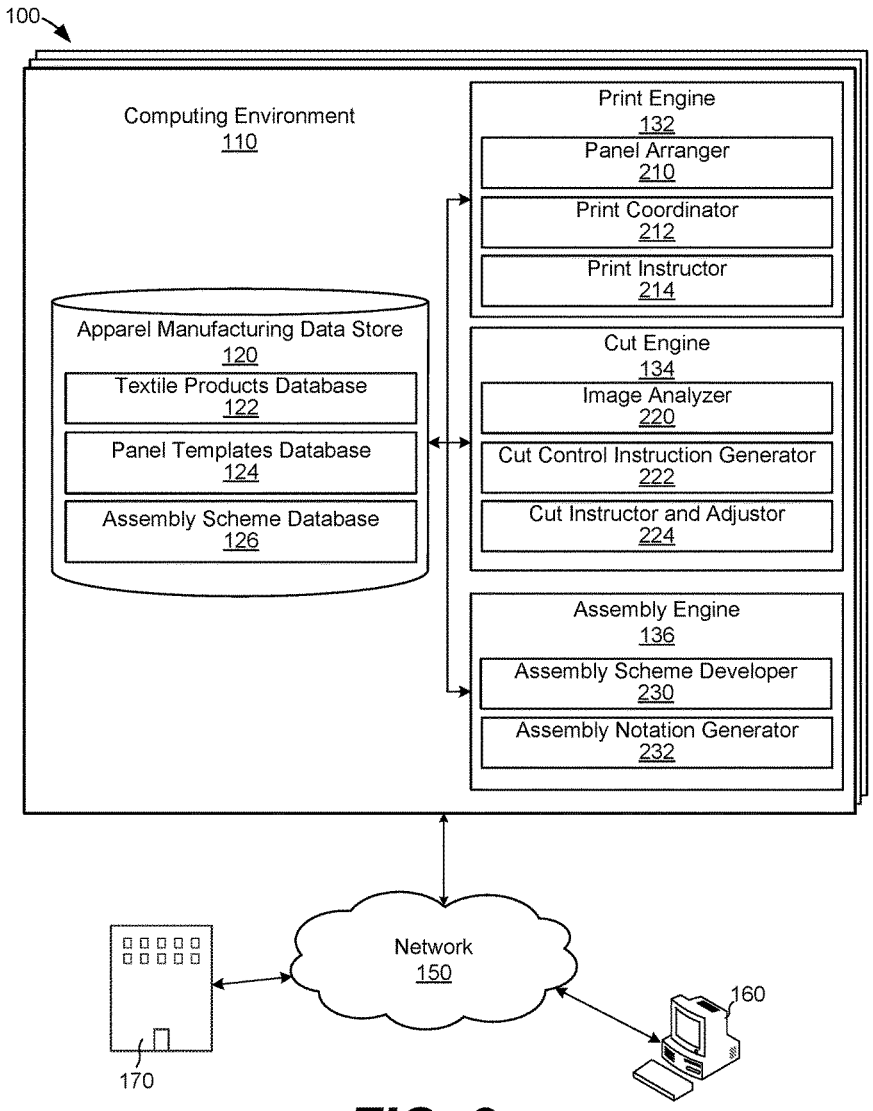
FIG. 2 illustrates a more detailed view of the computing environment for fluorescent ink printing, cutting, and apparel assembly shown in FIG. 1 according to various embodiments of the present disclosure.

Turning to FIG. 2, a more detailed view of the computing environment 110 in FIG. 1 is illustrated. The computing environment 110 can be embodied as one or more computers, computing devices, or computing systems. In certain embodiments, the computing environment 110 can include one or more computing devices arranged, for example, in one or more server or computer banks. The computing device or devices can be located at a single installation site or distributed among different geographic locations. The computing environment 110 can include a plurality of computing devices that together embody a hosted computing resource, a grid computing resource, and/or other distributed computing arrangement. In some cases, the computing environment 110 can be embodied as an elastic computing resource where an allotted capacity of processing, network, storage, or other computing-related resources varies over time. In other embodiments, the computing environment 110 can be embodied as the computing and/or control devices of the textile printer 172, textile dryer 174, textile cutter 176, textile production line 178, or any combination thereof. In that case, the network 150 can be omitted entirely and/or embodied as a local area network or interface at the facility 170.

The computing environment 110 can also be embodied, in part, as various functional and/or logic (e.g., computer-readable instruction, device, circuit, processing circuit, etc.) elements configured to direct the computing environment 110 to perform aspects of the embodiments described herein. Additionally, to the extent that it interfaces over the network 150 with computing and/or control devices of the textile printer 172, textile dryer 174, textile cutter 176, and textile production line 178 through service interfaces, application programming interfaces (APIs), etc., the computing environment 110 can be embodied as a collection of computing devices that includes the computing and/or control devices (or capabilities) of the textile printer 172, textile dryer 174, textile cutter 176, and textile production line 178.

The network 150 can include the Internet, intranets, extranets, wide area networks (WANs), local area networks (LANs), wired networks, wireless networks, cable networks, satellite networks, other suitable networks, or any combinations thereof. It is noted that the computing environment 110 can communicate with the computing and/or control devices of the textile printer 172, textile dryer 174, textile cutter 176, and textile production line 178 (FIG. 1) using various systems interconnect models and/or protocols, such as simple object access protocol (SOAP), representational state transfer (REST), real-time transport protocol (RTP), user datagram protocol (UDP), internet protocol (IP), transmission control protocol (TCP), and/or other protocols for communicating data over the network 150, without limitation. The network 150 provides connections to various client devices and network hosts, such as the client devices 160, website servers, file servers, networked computing resources, databases, data stores, or any other network devices or computing systems.

The client devices 160 can be embodied as any type of computing device, processing circuit, or processor based device or system used by individuals, including those embodied in the form of a desktop computer, a laptop computer, a personal digital assistant, a cellular telephone, or a tablet computer, among others. The client devices 160 can include one or more peripheral and/or input devices, such as keyboards, keypads, touch pads, touch screens, microphones, cameras, etc.

As shown in FIG. 2, the apparel manufacturing data store 120 includes a textile product database 122, a panel templates database 124, and an assembly scheme database 126. The print engine 132 includes a panel arranger 210, a print coordinator 212, and a print instructor 214. The cut engine 134 includes an image analyzer 220, a cut control instruction generator 222, and a cut instructor and adjustor 224. Further, the assembly engine 136 includes an assembly scheme developer 230 and an assembly notation generator 232.

The textile products database 122 includes data related to textile products to be printed, cut, and assembled. In that context, the textile product database 122 can include a database of tech packs, for example, along with any other specifications, instructions, and other information associated with textile products. The panel templates database 124 can include a database of the textile panel templates 190 generated by the print engine 132 and/or the assembly engine 136, as described herein. The assembly scheme database 126 can include a database of the assembly schemes generated by the assembly engine 136. The apparel manufacturing data store 120 is not limited to storing the information described above, as other information and/or data can also be stored in the apparel manufacturing data store 120.

Turning to the print engine 132, the panel arranger 210 is configured to generate the textile panel templates 190, which include various arrangements of panels 192 for the textile products. The panels 192 are representative of individual pieces of fabric for the textile products. Any number of panels 192 can be defined in the textile panel templates 190 along with print features, such as print patterns, assembly notations, and other information related to the panels 192 and/or the textile products as described herein. Thus, the textile panel templates 190 are representative of a group of instructions for the textile printer 172 to print certain panel outlines, print patterns, and assembly notations, and other print features on one or more textile sheets.

In one embodiment, the panel arranger 210 is configured to generate the textile panel templates 190 in a machine-readable computer-aided-manufacturing (CAM) or similar file format. In that case, the textile panel templates 190 can be provided, in relevant part(s), as instructions from the computing environment 110 to one or more of the textile printer 172, the textile dryer 174, or the textile cutter 176 over the network 150.

Once a number of print features are collected in the textile panel templates 190, the print coordinator 212 is configured to identify one or more of them to print using fluorescent ink. In that context, the apparel manufacturing data store 120 can include information related to the capabilities of the textile printer 172, such as printer driver or printer property information, including the types of inks or dyes available in the textile printer 172 for printing. Thus, the print engine 132 identifies certain print features in the textile panel templates 190 to print using fluorescent ink.

As one example, the print coordinator 212 can identify certain assembly notations 196, as a subset of the print features in the textile panel templates 190, to print using fluorescent ink based on an assembly notation syntax or other pre-determined definition of print features to be printed using fluorescent ink. These print features can include a combination of unique identifiers, fastener notations, stitch location markers, stitch start markers, stitch end markers, and other notations. The print features can also include panel outlines, blocks of text instructions, and other information for reference by the textile cutter 176, other automated systems, or individuals.

In some cases, the print features to be printed using fluorescent ink can be directly defined or identified by individuals operating the computing environment 110. In other cases, the print features can be identified or defined in tech packs 180 which define the characteristics and assembly instructions for textile products. Once the print features for fluorescent ink are selected or identified, that fluorescent ink printing information is incorporated into the textile panel templates 190.

The print instructor 214 is configured to coordinate the printing operations of textile printers, such as the textile printer 172, over the network 150. For example, the print instructor 214 can generate print instructions based on the textile panel templates 190 and forward those instructions (or the textile panel templates 190 themselves) to the textile printer 172. Based on the textile panel templates 190, the textile printer 172 can be instructed to print using a combination of various colors of the fluorescent inks and various colors of the non-fluorescent inks in the textile printer 172 as described herein. The print instructor 214 can also monitor the ongoing printing operations of the textile printer 172.

Once printed onto textile sheets by the textile printer 172, the cut engine 134 is configured to instruct the textile cutter 176 to cut the panels 192 out from the textile sheets. Here, the use of the fluorescent inks on the textile sheets can assist with cutting out the panels 192. For example, the textile cutter 176 can include one or more UV light sources (i.e., any suitable combination of UV, IR, and/or other fluorescent-ink-exciting light sources) to highlight the print features printed using the fluorescent inks. That fluorescent reflection can be captured by image sensors at the textile cutter 176 and used by the cut engine 134 to generate cut control instructions for the textile cutter 176.

The image analyzer 220 of the cut engine 134 is configured to capture images of the panels 192 printed onto textile sheets (or sheets of other materials) and analyze those images to assist with cutting operations. To that end, the textile cutter 176 can include an arrangement of cameras or image sensors to capture images of textiles and an arrangement of UV light sources (i.e., any suitable combination of UV, IR, and/or other fluorescent-ink-exciting light sources) to highlight the print features printed using fluorescent inks. The use of the fluorescent inks on the textile sheets thus can be used to assist with cutting out the panels 192.

Fluorescent reflections from the fluorescent inks can be captured in images by the cameras at the textile cutter 176 and used by the cut engine 134 to generate cut control instructions for the textile cutter 176. The images can include fluorescent reflections from fluorescent inks printed onto the textile sheets, particularly when highlighted by UV light sources. The cameras can capture these fluorescent reflections (along with standard reflections) and use them to identify various features printed on the textile sheets by the textile printer 172, such as the assembly notations 196, panel cutouts for the panels 192, cut alignment markers, and other features.

Based on the analysis performed by the image analyzer 220, the cut control instruction generator 222 can generate cut control instructions to cut out the panels 192 from the textile sheets. Similarly, the cut control instruction generator 222 can generate cut control instructions to cut out the panels 192 along with the assembly notations 196. Thus, the cut-out panels or fabric pieces can include the assembly notations 196 printed directly upon them, and some of those assembly notations 196 can be printed using fluorescent inks.

The cut control instructions can be generated in the form of a CAM or similar file format for processing and/or interpretation by the textile cutter 176. In the generation of cut control instructions, the cut control instruction generator 222 can refer to various types of information. For example, the cut control instruction generator 222 can refer to the analysis performed by the image analyzer 220, the textile panel templates 190, the specifications of the textile sheets (e.g., the type, thickness, grade, weave pattern, thread count, etc.) being cut, and other factors.

After they are generated, the cut instructor and adjustor 224 can forward the cut control instructions to the textile cutter 176 over the network 150. The cut instructor and adjustor 224 is also configured to adapt the cut control instructions, over time and during cutting operations, based on the analysis performed by the image analyzer 220. By capturing images of textile sheets after panels and/or print patterns have been printed on them and adjusting the cut control instructions provided to the textile cutter 176 using feedback gathered from images, the cut instructor and adjustor 224 can dynamically adjust the cutting operations performed by the textile cutter 176.

Once they are cut out, the panels 192 can be assembled by sewing workers or other automated systems on the textile production line 178, for example. Even after the panels 192 are printed and cut out from a textile sheet, it can still be helpful to provide instructions as to how the panels 192 should be assembled together to form finished textile products.

To help provide those instructions, the assembly scheme developer 230 of the assembly engine 136 is configured to generate assembly schemes for the assembly of textile products. An assembly scheme can include an ordered set of assembly tasks, such as stitching seams, attaching fasteners, hemming sides, etc. The assembly notation generator 232 is configured to generate a set of assembly notations 196 based on assembly tasks in the assembly schemes. The assembly notations 196 can be generated based on an assembly notation syntax that incorporates certain symbols, letters, numbers, and/or colors to designate various tasks and/or an order of those tasks. For example, assembly notation symbols can designate a stitch start marker, a stitch end marker, an assembly instruction block, or an assembly alignment marker, among other assembly symbols.

The assembly notation generator 232 can also select different colors for the assembly notations 196 according to the assembly notation syntax, where the colors can indicate various tasks and/or an order of those tasks. Some of the assembly notations 196 can be printed by the textile printer 172 using various colors of the fluorescent inks. The assembly notations 196 can be embodied using various colors and/or shapes of symbols, numbers, text, and other unique and/or distinguished instructions to convey assembly information.

The assembly notation generator 232 is also configured to incorporate the assembly notations 196 into the textile panel templates 190 so that they can be printed onto textile sheets. When incorporating the assembly notations 196 into the textile panel templates 190, the assembly notation generator 232 can identify appropriate or preferred locations to insert each assembly notation 196.

The assembly notation generator 232 can also generate machine-readable representations, such as bar or matrix codes, of unique identifiers for the panels 192, assembly tasks, or other print features. Those machine-readable representations can also be incorporated into the textile panel templates 190 at certain locations. Once the assembly notations 196 are incorporated into the textile panel templates 190, the textile printer 172 can print out the assembly notations 196 along with the panels 192 for reference by sewing workers as described in further detail below.

Figure 3:
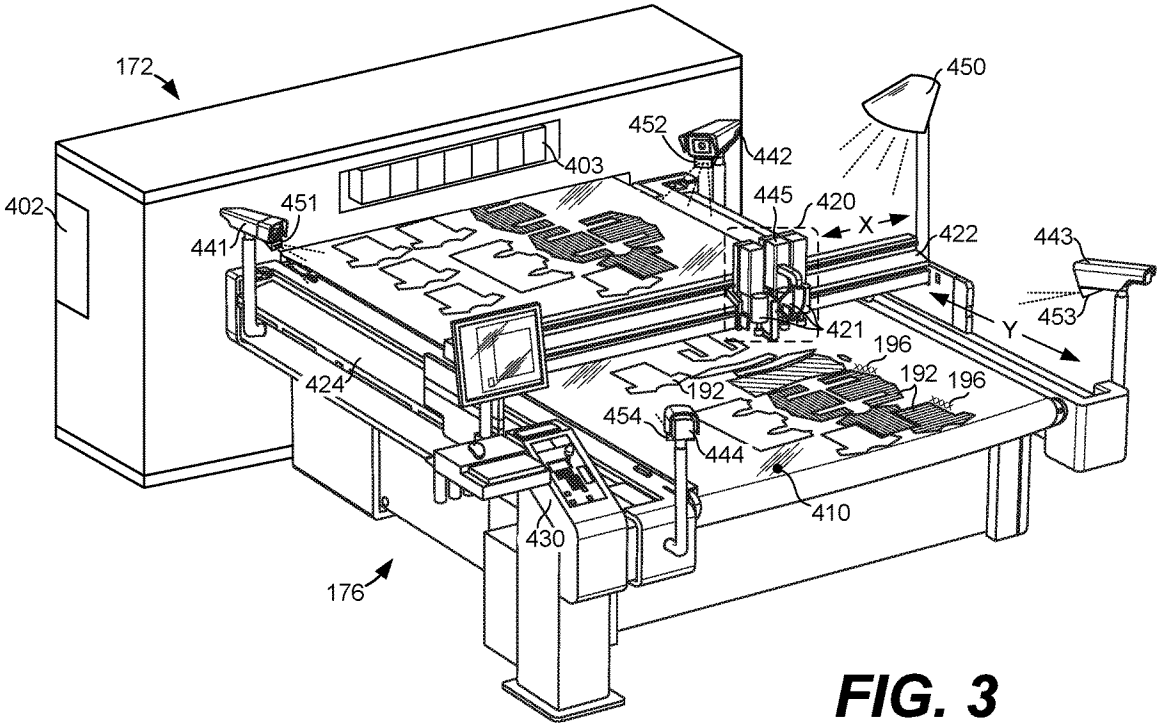
FIG. 3 illustrates an example textile printer and textile cutter for fluorescent ink printing and cutting according to various embodiments of the present disclosure.

FIG. 3 illustrates the textile printer 172 and the textile cutter 176 according to various embodiments of the present disclosure. In FIG. 3, the textile dryer 174 shown in FIG. 1 is omitted for simplicity. It is noted, however, that the textile dryer 174 can be placed between the textile printer 172 and the textile cutter 176 or incorporated with the textile printer 172.

The textile printer 172 includes a controller 402 that directs the operation of the textile printer 172. The controller 402 can be embodied as any suitable combination of analog, digital, or analog and digital processing circuitry, including memory, configured to control the operation of textile printer 172. Thus, the controller 402 can be embodied as a collection of vendor-specific logic, software, and/or hardware that directs the textile printer 172 to perform various printing operations. The controller 402 also includes the physical and logical interfaces for two-way control communications with the print engine 132 over the network 150, such as physical layer network interfaces, service interfaces, APIs, etc.

The textile printer 172 also includes tanks 403 of inks or dyes for printing. Each of the tanks 403 can hold a different color or type of non-fluorescent or fluorescent ink. The non-fluorescent inks can include a set of permanent inks based on the subtractive cyan, magenta, yellow, and key (black) (CMYK) color model used in color printing. In that case, the tanks 403 can hold cyan, magenta, yellow, and black permanent inks, although the use of other colors of inks are within the scope of the embodiments.

In addition to the non-fluorescent inks, the tanks 403 can hold one or more fluorescent inks that reflect UV or IR light in at least one visible wavelength. In one example, the fluorescent inks can be embodied as washable protein-based fluorescent inks, but the fluorescent inks need not be washable or protein-based in every case. Fluorescence involves the absorbance of light or radiation, such as UV or IR, followed by the emission of light by a fluorescent substance. The wavelength of the absorbed light can be, and typically is, different than that emitted. For example, light emitted from a fluorescent substance may have a longer wavelength and lower energy than that absorbed. Fluorescent reflections have a distinct color when exposed to UV light. Without the exposure to UV or some other wavelength(s) of exciting light, the fluorescent substance may not be visible at all.

A relatively well-known type of fluorescent substance is green fluorescent protein (GFP). GFP is a protein including amino acid residues that exhibit bright green fluorescence when exposed to certain ranges of UV light. Although many other marine organisms have similar green fluorescent proteins, GFP traditionally refers to the protein first isolated from the jellyfish *Aequorea victoria*. GFP isolated from the jellyfish *Aequorea victoria*, for example, exhibits a primary excitation at a wavelength of about 395 nm and a minor excitation at a wavelength of about 475 nm. The fluorescent reflection emission peak for GFP from the jellyfish *Aequorea victoria*, on the other hand, is at about 509 nm, which is in the green portion of the visible spectrum. Fluorescent substances can emit light at wavelengths other than in the green portion of the visible spectrum. For example, fluorescent substances, such as certain proteins, can emit wavelengths in the red, yellow, orange, blue, and other portions of the visible spectrum. Thus, a first fluorescent ink can emit or reflect UV light in a first visible wavelength to present a first color of fluorescent reflection and a second fluorescent ink can emit or reflect UV light in a second visible wavelength to present a second color of fluorescent reflection.

Fluorescent inks and dyes, such as those used in the textile printer 172, can be prepared by mixing one or more fluorescent substances or materials, such as GFP, yellow fluorescent protein (YFP), red fluorescent protein (RFP), orange fluorescent protein (OFP), blue fluorescent protein (BFP), other fluorescent proteins, or combinations thereof, with one or more other inks, solvents, and/or diluents. In some cases, fluorescent inks can also include photoinitiators or other reactants, but they are not necessary for all inks.

The solvents employed in fluorescent inks can be selected to dissolve the fluorescent substances in the inks and also to penetrate the printing substrate upon which inks are to be applied. By penetrating printing substrates, the solvent allows the fluorescent substances to impregnate the substrates. When the solvent evaporates, the fluorescent substances are impregnated in or on the substrates. Any suitable polar or non-polar solvent can be used, including but not limited to a water or alcohol-based solvent.

In some compositions, fluorescent inks and dyes can be invisible once applied and only seen under UV or IR light. In other cases, such as when mixed with other opaque or semi-opaque inks, fluorescent inks may be visible once applied. Invisible fluorescent inks can be used for verification, to combat forgery, to identify the authenticity of products or documents, and for other purposes such as those described herein.

As described above, the textile printer 172 receives print control instructions from the print engine 132 over the network 150. For example, the print instructor 214 can generate print instructions based on one or more of the textile panel templates 190 and forward those instructions (or the textile panel templates 190 themselves) to the textile printer 172 for printing. The print instructor 214 can also monitor the ongoing printing operations of the textile printer 172 and coordinate the printing operations with the cutting operations performed by the textile cutter 176.

Based on the print control instructions received from the print engine 132, the textile printer 172 can print panel outlines, patterns, assembly notations 196, and other print features for the panels 192 on the textile sheet 410 (or sheets of other material(s)). The panels 192, assembly notations 196, and print patterns shown in FIG. 3 are representative, and it is noted that the textile printer 172 can print any other arrangements of the panels 192, assembly notations 196, and other print features. According to aspects of the embodiments, the textile printer 172 can print certain print features using non-fluorescent inks and other print features using fluorescent inks based on the print control instructions received from the print engine 132.

After printing, the textile sheet 410 is fed from the textile printer 172 to the textile cutter 176, where the panels 192 and assembly notations 196 are cut out from the textile sheet 410. Similar to the textile printer 172, the textile cutter 176 includes a controller 430 that directs the operation of the textile cutter 176. The controller 430 can be embodied as any suitable combination of analog, digital, or analog and digital processing circuitry, including memory, configured to control the operation of the textile cutter 176. Thus, the controller 430 can be embodied as a collection of vendor-specific logic, software, and/or hardware that directs the textile cutter 176 to perform various cutting operations. The controller 430 also includes the physical and logical interfaces for two-way control communications with the cut engine 134 over the network 150, such as physical layer network interfaces, service interfaces, APIs, etc.

The textile cutter 176 can also include adjustable vacuums, rollers, clips, hold-downs, etc., to hold and/or maneuver the textile sheet 410 as it is being fed from the textile printer 172 for cutting. In one embodiment, the textile cutter 176 includes a cutting head assembly 420 adjustably mounted to an articulating rail 422. The articulating rail 422 is adjustably mounted to a table 424 of the textile cutter 176. Using motors, pulleys, or another suitable mechanism, the cutting head assembly 420 can move or slide along the articulating rail 422 in the "X" direction, and the articulating rail 422 can move or slide along the table 424 in the "Y" direction. Thus, the cutting head assembly 420 is configured to traverse the table 424 to cut panels out from the textile sheet 410.

The cutting head assembly 420 includes one or more tools 421 for cutting panels out of the textile sheet 410. For example, the tools 421 can include one or more drag knives, wheel knives, lasers, pneumatic and/or electric oscillating cutting knives and/or tools, pneumatic and/or electric rotary cutting knives and/or tools, scoring tools, v-cutting (e.g., scissor-type) tools, partout tools, creasing tools, routing and/or engraving tools, and other types of tools for cutting and/or manipulating the textile sheet 410. In other examples, the textile cutter 176 can be embodied as a continuous feed laser cutting system such as that described in the '855 application.

The textile cutter 176 also includes cameras 441-444 placed around the table 424 and, in some embodiments, another camera 445 in the cutting head assembly 420. The camera 445 in the cutting head assembly 420 provides a close view of the tools 421 and the operations performed by the tools 421. The positions of the cameras 441-445 are representative, however, and various cameras can be placed at other locations. The cameras 441-445 can include any suitable type of image sensor(s) for capturing the details of the textile sheet 410 and fluorescent reflections from fluorescent inks. In various embodiments, the cameras 441-445 can include filtered and/or non-filtered high-resolution image sensors (or any combination thereof) capable of capturing thread or weave patterns in the textile sheet 410, as well as fine details printed on the textile sheet 410 by the textile printer 172 and fluorescent reflections from fluorescent inks. In some cases, the types of image sensor(s) used in the cameras 441-445 can be determined, in part, based on the wavelength of fluorescent reflections from fluorescent inks in the tanks 403.

To create the fluorescent reflections from fluorescent inks, the textile cutter 176 can also include one or more UV or IR light sources, such as the UV sources 450-454. The UV sources 450-454 can emit light having UV wavelengths lower than about 400 nanometers and/or IR wavelengths higher than about 780 nanometers, although it can also emit some light in the visible range between about 400 and 780 nanometers. As shown in FIG. 3, the UV sources 450-454 direct UV light at the table 424 of the textile cutter 176 and, thus, the textile sheet 410. The positions of the UV sources 450-454 are representative in FIG. 3, and any number of other UV light sources can be placed at other locations. For example, an additional UV light source can be incorporated in the cutting head assembly 420 to provide a relatively more direct illumination of the textile sheet 410 with UV light. The UV sources 450-454 can be controlled (e.g., turned on and off) by the controller 430 and/or instructions from the cut engine 134. In addition to controlling the UV sources 450-454, the cut engine 134 can control other, non-UV light sources to turn on and off in some embodiments. Thus, when turning on the UV sources 450-454, the cut engine 134 can also turn off incandescent, compact fluorescent, light emitting diode, or other non-UV light sources. In that way, any fluorescent reflections from fluorescent inks can be relatively more pronounced.

Using images captured by the cameras 441-445, the image analyzer 220 is configured to identify print features and/or factors to control the cut of the textile sheet 410 by the textile cutter 176 as noted above. For example, various print features, whether printed using fluorescent or non-fluorescent inks, can be identified and used to direct the cutting processes by the textile cutter 176. Additionally, a textile thread, weave, nap, or knit pattern of the textile sheet 410, textile print pattern alignment on the textile sheet 410, or panel deformation of the textile sheet 410, can be identified by the image analyzer 220. The image analyzer 220 can also identify certain features printed on the textile sheets by the textile printer 172, such as the assembly notations 196, panel cutouts for the panels 192, cut alignment markers, and other features, whether printed using fluorescent or non-fluorescent inks.

Figure 4:
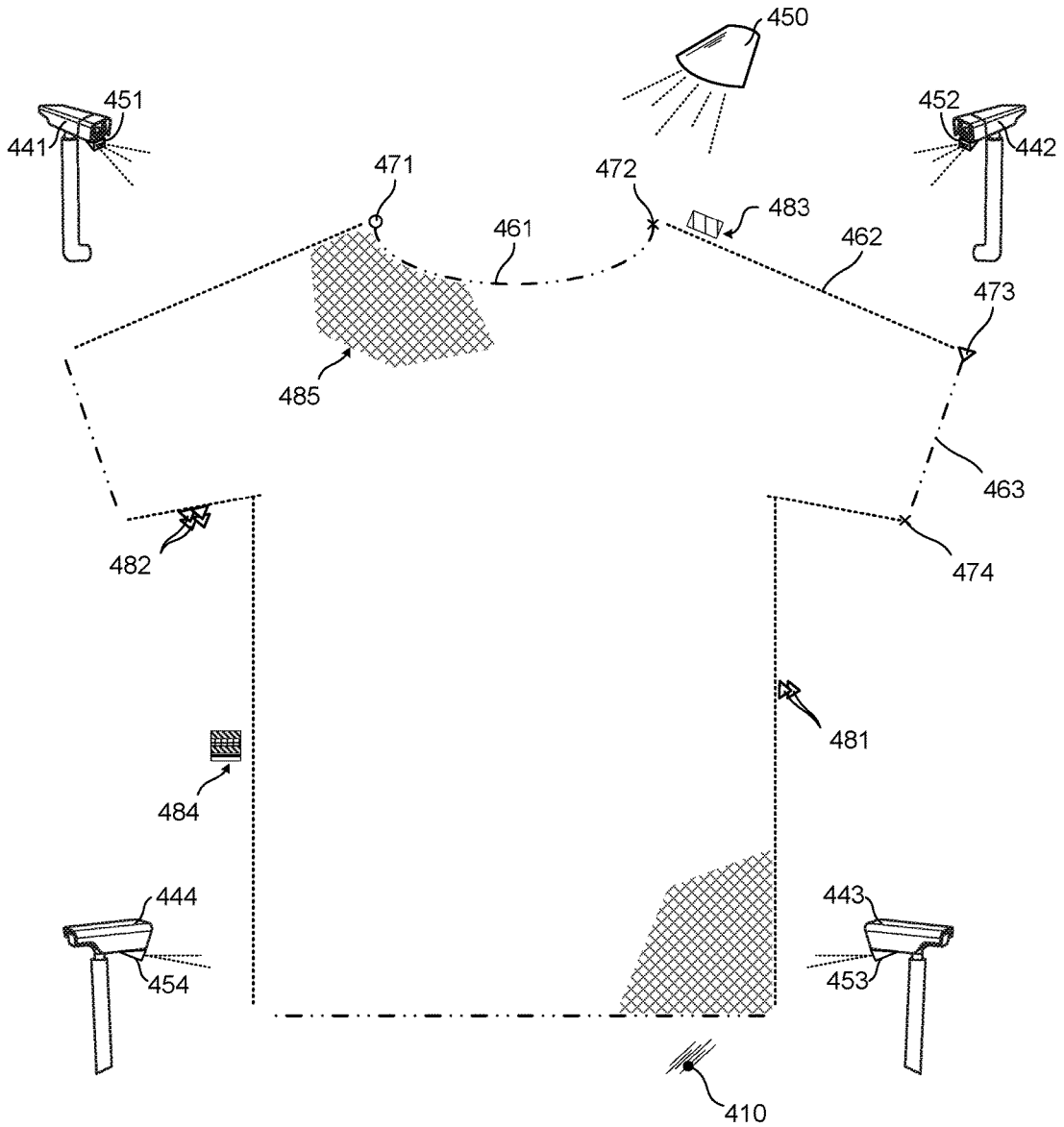
FIG. 4 illustrates an example of a textile sheet including fluorescent ink printed on panels for a textile product according to various embodiments of the present disclosure.

FIG. 4 illustrates an example of the textile sheet 410 including fluorescent ink printed on panels for a textile product. In the example shown in FIG. 4, various print features have been printed on the textile sheet 410 by the textile printer 172 using fluorescent inks, non-fluorescent inks, or a combination of fluorescent and non-fluorescent inks. As examples of print features, various assembly notations, including panel outlines 461-463, stitch notations 471-474, alignment marks 481 and 482, and machine-readable identifiers 483 and 484 are shown in FIG. 4. FIG. 4 also illustrates the print graphic 485, and it can also be printed using fluorescent and/or non-fluorescent inks.

The print features shown in FIG. 4 are provided by way of example and are not intended to be exhaustive of the types of features or notations that can be printed on panels according to the embodiments described herein. In addition to those shown, the print features can include various instructions, pointers, references, and other information. Additionally, the print features can specify the type of and locations for fasteners (e.g., buttons, zippers, etc.) in textile products, using fluorescent and/or non-fluorescent inks. It is also noted that the print features can be printed on either side of the textile sheet 410.

As noted above, the print coordinator 212 in the computing environment 110 can identify certain print features, such as one or more of the panel outlines 461-463, stitch notations 471-474, alignment marks 481 and 482, and machine-readable identifiers 483 and 484, among others, to print using fluorescent ink. The print coordinator 212 can identify or determine features to be printed using fluorescent ink based on an assembly notation syntax or other pre-determined definition. If the print features are associated with assembly tasks, the print coordinator 212 can also work in connection with the assembly notation generator 232 to identify features to be printed using fluorescent ink depending upon the type of assembly tasks. Additionally, the print coordinator 212 can assign or select different colors of fluorescent ink to various print features, to convey information or distinguish particular print features.

The panel outlines 461-463 designate boundaries or seam lines along a panel. A sewing worker on the textile production line 178 can refer to the panel outlines 461-463 to gather information about the locations of seams, hems, etc. In some cases, the style (e.g., linewidth, line pattern, color, etc.) of the panel outlines 461-463 can be used to designate a particular edge of a panel or type of seam. For example, the dotted line of the panel outline 462 can designate a seam line, while the dashed line of the panel outline 461 can designate a hem line. In other examples, the panel outlines 461-463 can additionally or alternatively be printed using different color fluorescent inks to designate different types of seams, hems, etc. The panel outlines 461-463 can also designate different seam allowances, stitch patterns, thread types, thread colors, and other information using different types of dotted and dashed lines, line colors, etc.

The stitch notations 471-474 can designate start and end locations for seams, hems, etc. The stitch notations 471-474 can be printed as certain symbols, shapes, characters, or other indicators representative of starting and/or ending stitch locations. For example, as shown in FIG. 4, the circular stitch notation 471 is representative of a start location for a hem, and the cross notation 472 is representative of an end location for the hem. Similarly, the triangular stitch notation 473 is representative of a start location and the cross notation 474 is representative of an end location. The stitch notations 471-474 can follow an assembly notation syntax to provide assembly sequence information. The assembly notation syntax can specify that the first step in the assembly of a textile product is designated using a circular stitch notation, the second step is designated using a square stitch notation, a third step is designated using a triangular stitch notation, etc. The alignment marks 481 and 482 designate how a cut-out panel can be aligned together with other panels before they are stitched together.

The machine-readable identifiers 483 and 484, which can be machine-readable bar or matrix codes, for example, can be representative of various types of information, such as unique product identifiers, unique panel identifiers, unique seam identifiers, and/or particular assembly tasks. For example, the machine-readable identifier 483 can be associated with a unique product or panel identifier. Similarly, the machine-readable identifier 484 can be associated with a unique seam identifier. The machine-readable identifiers 483 and 484 can be scanned by a sewing worker or other automated equipment to generate a query to the computing environment 110. The query can return information related to various panels or textile products, for example, as described in the '867 application.

As noted above, any of the panel outlines 461-463, stitch notations 471-474, alignment marks 481 and 482, and machine-readable identifiers 483 and 484 can be printed by the textile printer 172 using fluorescent inks. To create fluorescent reflections from those fluorescent inks, the UV sources 450-454 of the textile cutter 176 (or any other suitable UV light source) can direct UV light at the textile sheet 410. The position of the UV sources 450-454 are representative in FIG. 4, and any number of other UV light sources can be placed at other locations. When the UV sources 450-454 are on, the cameras 441-445 can capture fluorescent reflections from any of the print features printed on the textile sheet 410 using fluorescent inks. Using images captured by the cameras 441-445 (and others), the image analyzer 220 is configured to identify print features and/or factors to control the cut of the textile sheet 410 by the textile cutter 176 as noted above.

Figure 5A:
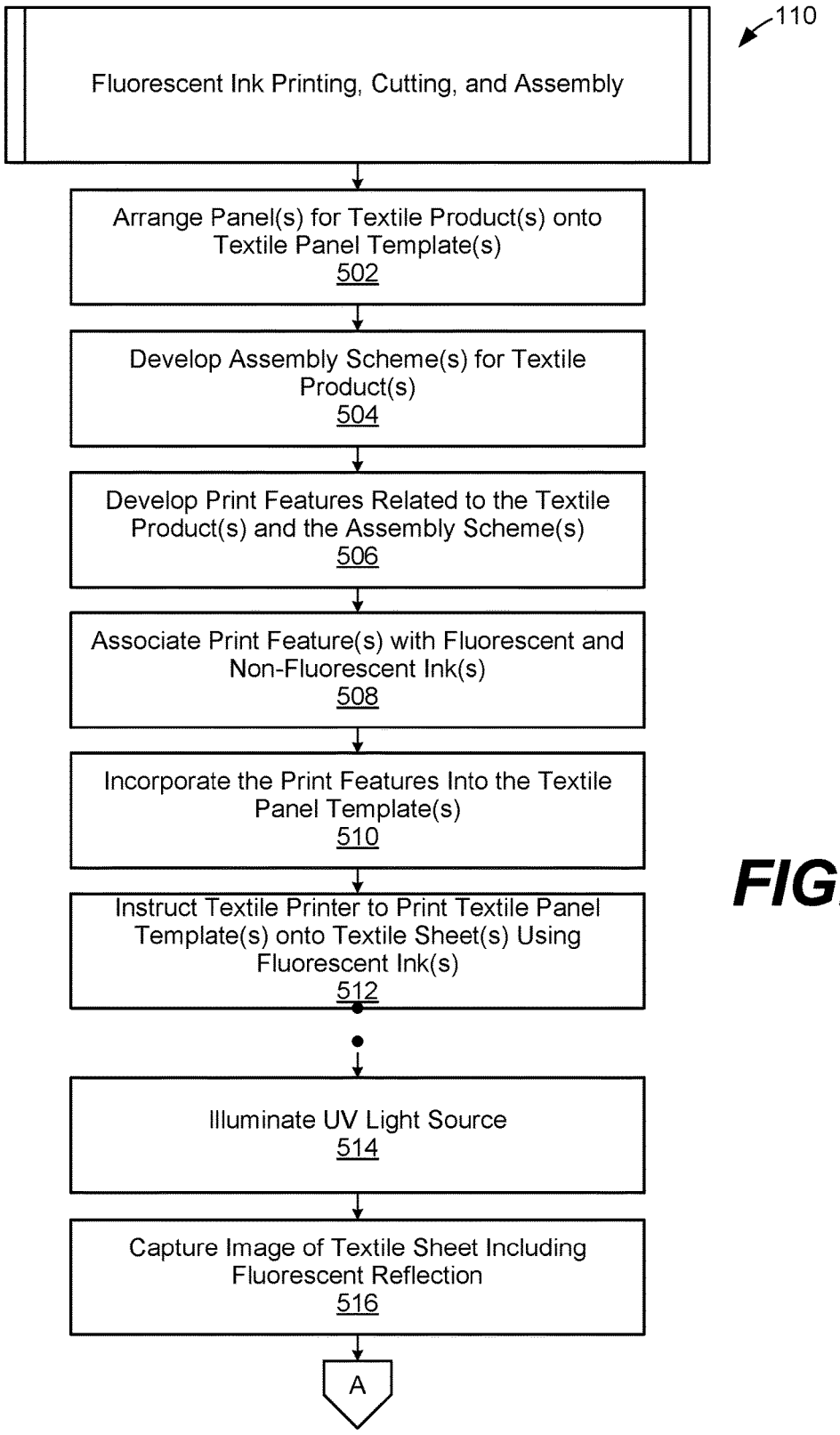
FIG. 5A illustrates an example printing process using fluorescent ink according to various embodiments of the present disclosure.
Figure 5B:
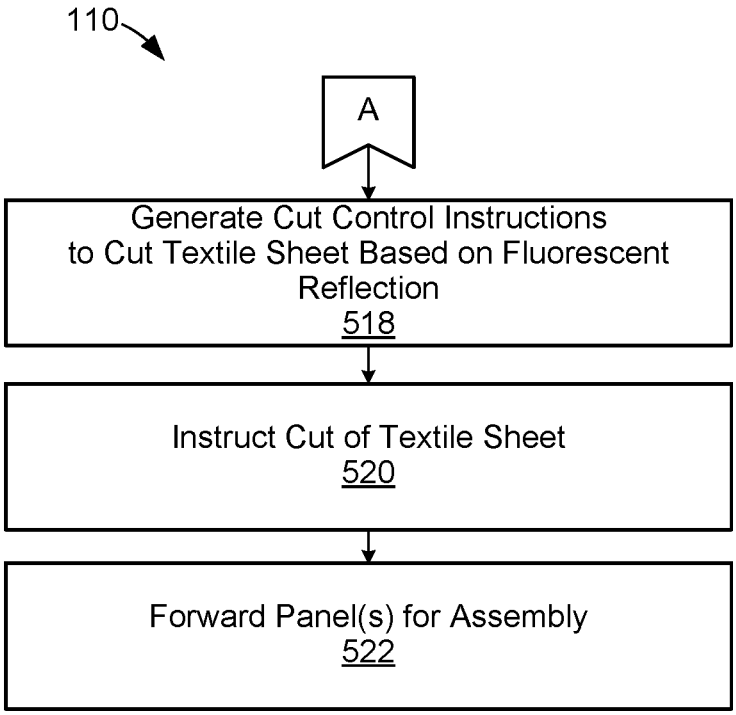
FIG. 5B further illustrates the example printing process shown in FIG. 5A according to various embodiments of the present disclosure.

Turning to FIGS. 5A and 5B, an example printing process using fluorescent ink is illustrated. The process can be performed in the networked environment 100 in FIG. 1 according to various embodiments of the present disclosure. In certain aspects, the flowchart shown in FIGS. 5A and 5B may be viewed as depicting an example group of steps performed in the networked environment 100 according to one or more embodiments. It should be appreciated that the flowchart shown in FIGS. 5A and 5B provides merely one example of a functional sequence or arrangement that may be employed to implement the operations of the networked environment 100 described herein. Further, although the process is described in connection with the computing environment 110, textile printer 172, textile cutter 176, and textile production line 178 shown in FIGS. 1 and 2, the process can be conducted in other environments.

At reference numeral 502, the process includes the panel arranger 210 arranging panels 192 for textile products into one or more of the textile panel templates 190. The panels 192 in the textile panel templates 190 can be representative of one or more sections, portions, or pieces of fabric or other materials for one or more shirts, pants, dresses, or other accessories or items to be manufactured. In one embodiment, when arranging the panels 192, the panel arranger 210 is configured to align the panels 192 to reduce scrap or to align them with a thread, weave, nap, knit, or print pattern(s) in textile sheets. Other examples of the arrangement of panels are described in the '874 application.

At reference numeral 504, the process includes the assembly engine 136 developing one or more assembly schemes associated with the panels in the textile panel templates 190. For example, the assembly scheme developer 230 can determine and compile a list of assembly tasks to assemble the textile products associated with textile panel templates 190 created at reference numeral 502. The assembly tasks can include seaming tasks, hemming tasks, fastener (e.g., button, zipper, etc.) attachment tasks, and other tasks required for the assembly of textile products. Further, the assembly scheme developer 230 can recognize variations of the same type of task, such as different types of stitch classes, seam allowances, and thread colors for seam stitching tasks. As assembly scheme developer 230 compiles the list of assembly tasks, it can also assign unique task identifiers to each of the tasks and store those unique task identifiers in the apparel manufacturing data store 120.

The assembly tasks can be compiled based on assembly specification information contained in the tech packs 180. However, the assembly scheme developer 230 can also determine assembly tasks, or aspects of assembly tasks, without any specification of those tasks in the tech packs 180. For example, a tech pack 180 may designate sewing a seam along edges of certain panels in a textile product, but not the type and/or color of the thread to be used to stitch those seams together. In that case, the assembly scheme developer 230 can determine an appropriate type of thread and color of thread to be used.

At reference numeral 506, the process includes the assembly notation generator 232 developing a set of print features, such as the assembly notations 196, based on the assembly tasks determined and compiled at reference numeral 504. For example, the assembly notations 196 can designate various seams, types of stitching, stitch start markers, stitch end markers, assembly alignment markers, and other instructions such as those illustrated in FIG. 4. The assembly notations 196 can also include machine-readable representations of unique panel identifiers, unique seam identifiers, and/or particular assembly tasks. As described herein, the assembly notations 196 can make use of different colors according to the assembly notation syntax, where the colors can indicate various tasks and/or an order of those tasks. The assembly notations 196 can also be generated using certain assembly notation symbols, letters, numbers, and/or colors to designate various tasks and/or an order of those tasks according to the assembly notation syntax.

At reference numeral 508, the process includes the print coordinator 212 associating certain print features to be printed using fluorescent ink. For example, the print coordinator 212 can assign one or more of the panel outlines 461-463 to be printed with a first color of fluorescent ink and assign one or more of the stitch notations 471-474 to be printed with a second color of fluorescent ink. As noted above, the print coordinator 212 can identify certain print features or assembly notations 196 to print using fluorescent ink based on an assembly notation syntax or other predetermined definition of print features to be printed using fluorescent ink. These print features can include a combination of unique identifiers, fastener notations, stitch location markers, stitch start markers, stitch end markers, and other notations. Additionally, the print coordinator 212 can assign or select different colors of fluorescent ink to various print features, to convey information or distinguish particular print features. Similarly, the print coordinator 212 can associate various print features to be printed using non-fluorescent inks at reference numeral 508.

At reference numeral 510, the process further includes the assembly notation generator 232 incorporating the print features into the textile panel templates 190 as described herein. At this point, the textile panel templates 190 include a definition of certain print features, such as the assembly notations 196, along with various colors of fluorescent and non-fluorescent inks to print those features.

At reference numeral 512, the process includes the print engine 132 instructing the textile printer 172 to print onto one or more textile sheets. Particularly, the process includes the print instructor 214 generating instructions with reference to one or more of the textile panel templates 190 and forwarding those instructions to the textile printer 172. In turn, the textile printer 172 prints the print features according to the instructions from the print instructor 214. The instructions can define printing various features, such as the assembly notations 196, using various colors of fluorescent and non-fluorescent inks.

After printing on textile sheets, the textile sheets can be fed onto a textile cutter as illustrated in the example shown in FIG. 3. In other examples, the textile sheets can be fed onto a continuous feed laser cutting system such as that described in the '855 application or another type of textile cutting machine, whether manually or automatically operated. It is not necessary that the textile sheets be fed to a cutting machine, however, because the textile sheets can be used with or without cutting in various embodiments. Also, the textile sheets can be cut by hand or any other suitable way.

At reference numeral 514, the process includes the cut engine 134 illuminating a UV or IR light source. For example, as shown in FIG. 3, the cut engine 134 can instruct one or more of the UV sources 450-454 to turn on and direct UV light toward the textile sheet 410. In that way, the UV sources 450-454 can be controlled (e.g., turned on and off) by instructions from the cut engine 134. In addition to controlling the UV sources 450-454, the cut engine 134 can control other, non-UV light sources to turn on and off in some embodiments. Thus, when turning on the UV sources 450-454, the cut engine 134 can also turn off incandescent, compact fluorescent, light emitting diode, or other non-UV light sources. In that way, any fluorescent reflections from fluorescent inks can be relatively more pronounced. In other embodiments, the process at reference numeral 514 can be omitted entirely, for example, and the UV sources 450-454 can produce UV light at all times.

At reference numeral 516, the process includes the cut engine 134 capturing one or more images of textile sheets on the textile cutter 176. For example, the image analyzer 220 can direct the cameras 441-445 of the textile cutter 176 to capture images of the textile sheet 410 as it is being advanced through and cut by the textile cutter 176. Here, the use of the fluorescent inks can assist with cutting out the panels 192 from the textile sheet 410. For example, the UV light sources 450-454 can highlight the print features printed on the textile sheet 410 using the fluorescent inks and distinguish them from features printed on the textile sheet 410 using non-fluorescent inks. The fluorescent reflections from the fluorescent inks can be captured by image sensors in the cameras 441-445 at the textile cutter 176 and used by the cut engine 134 to generate cut control instructions for the textile cutter 176.

Turning to FIG. 5B, at reference numeral 518, the process includes the cut control instruction generator 222 generating cut control instructions for the textile cutter 176 to cut out the panels 192 from the textile sheet 410. Again, the use of the fluorescent inks can assist with cutting out the panels 192 from the textile sheet 410. Fluorescent reflections can be captured by image sensors in the process at reference numeral 516, and those fluorescent reflections can distinguished from other reflections by the image analyzer 220. For example, fluorescent substances in fluorescent inks can emit certain known wavelengths (or relatively narrow ranges of wavelengths) in the red, yellow, orange, blue, and other portions of the visible spectrum. Each of those different wavelengths of colors can be associated with a particular type of cutting task, such as different types of cutting using different types of cutting tools. Additionally, a group of the different wavelengths of colors can be associated with a sequence of cutting tasks.

Because the different wavelengths of colors are predetermined and known by the image analyzer 220, the image analyzer 220 can more easily distinguish them from other image features using wavelength-specific image processing techniques, such as wavelength-specific intensity level thresholding techniques, for example. Thus, the image analyzer 220 can more easily distinguish certain print features, such as the panel outlines 461-463, stitch notations 471-474, alignment marks 481 and 482, and machine-readable identifiers 483 and 484, when they are printed using fluorescent inks. In turn, the cut control instruction generator 222 can more accurately generate cutting instructions.

At reference numeral 520, the process includes the cut engine 134 instructing the textile cutter 176 to cut the panels 192 out from the textile sheet 410. Additional examples of the generation of the cut control instructions and the control of the textile cutter 176 by the cut engine 134 are described in further detail in the '840 application.

At reference numeral 522, the process includes the assembly engine 136 forwarding the cut-out panels 192 to and/or along the textile production line 178 for assembly. On the textile production line 178, sewing workers can view the assembly notations by illuminating the fluorescent inks using UV or IR light sources. The sewing workers can then refer to the assembly notations to help determine how textile products should be assembled or finished. For example, a sewing worker on the textile production line 178 can refer to the panel outlines 461-463 to gather information about the locations of seams, hems, etc. The panel outlines 461-463 can be printed using various colors of fluorescent inks to designate different types of seams, hems, etc. The panel outlines 461-463 can also designate different seam allowances, stitch patterns, thread types, thread colors, and other information using different types of dotted and dashed lines, ink colors, etc. Similarly, the stitch notations 471-474 can designate start and end locations for seams, hems, etc., and the alignment marks 481 and 482 can designate how a cut-out panel can be aligned together with other panels before they are stitched together. Finally, the machine-readable identifiers 483 and 484 can be representative of various types of information, such as unique product identifiers, unique panel identifiers, unique seam identifiers, and/or particular assembly tasks.

As noted above, any of the panel outlines 461-463, stitch notations 471-474, alignment marks 481 and 482, machine-readable identifiers 483 and 484, or other print features can be printed by the textile printer 172 using fluorescent inks. To create fluorescent reflections from those fluorescent inks, a UV source can be used to direct UV light at the fluorescent inks printed on the cut-out panels 192. Further, because the fluorescent inks can be washable, the print features can be removed by washing the textile products after they are assembled but before or after they are distributed for sale or sold.

Figure 6:
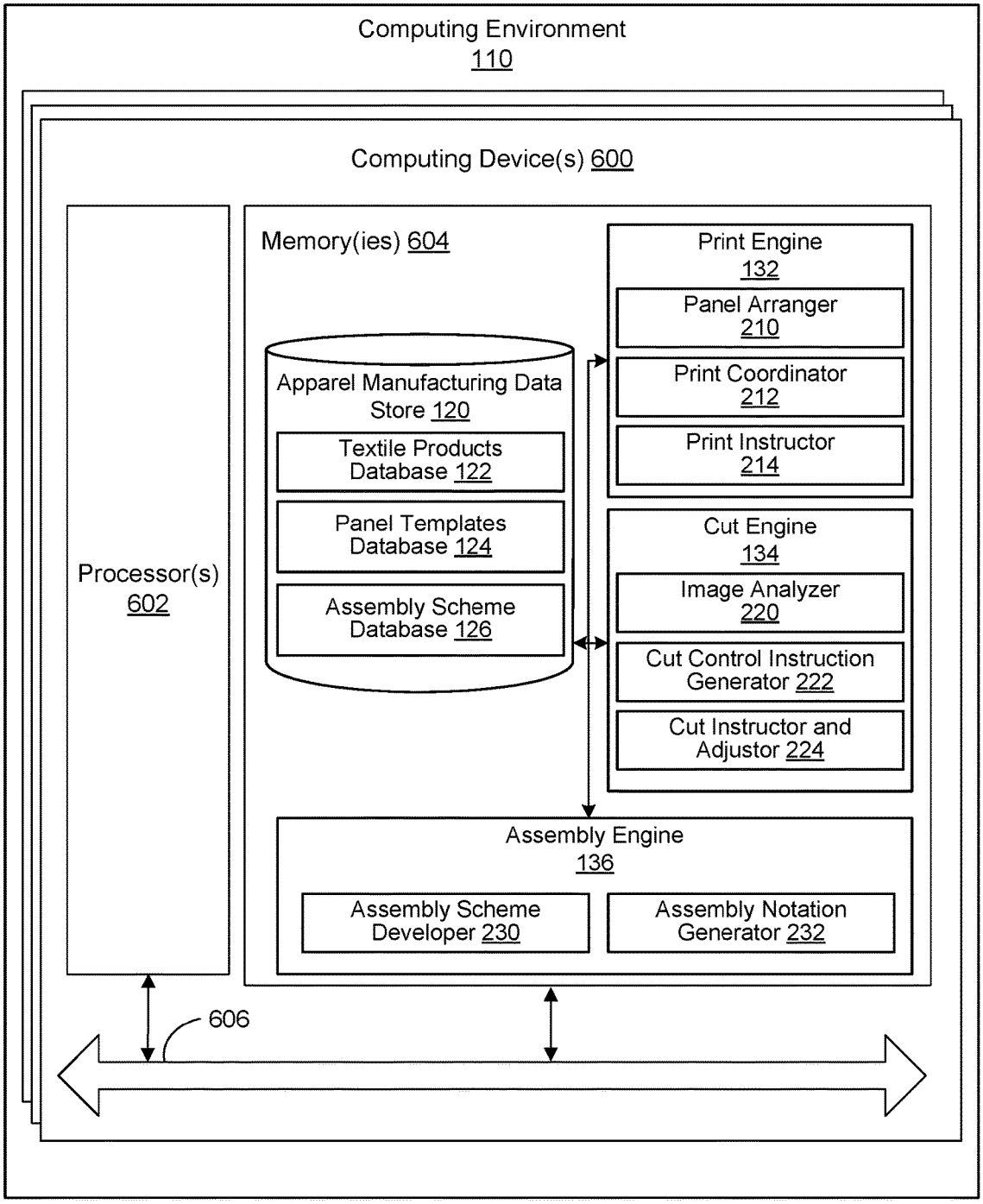
FIG. 6 illustrates an example schematic block diagram of the computing environment employed in the networked environment shown in FIG. 2 according to various embodiments of the present disclosure.

FIG. 6 illustrates an example schematic block diagram of the computing environment 110 employed in the networked environment 100 shown in FIGS. 1 and 2 according to various embodiments of the present disclosure. The computing environment 110 includes one or more computing devices 600. Each computing device 600 includes at least one processing system, for example, having a processor 602 and a memory 604, both of which are electrically and communicatively coupled to a local interface 606. To this end, each computing device 600 can be embodied as, for example, at least one server computer or similar device. The local interface 606 can be embodied as, for example, a data bus with an accompanying address/control bus or other bus structure as can be appreciated.

In various embodiments, the memory 604 stores data and software or executable-code components executable by the processor 602. For example, the memory 604 can store executable-code components associated with the print engine 132, the cut engine 134, and the assembly engine 136 for execution by the processor 602. The memory 604 can also store data such as that stored in the apparel manufacturing data store 120, among other data.

It should be understood and appreciated that the memory 604 can store other executable-code components for execution by the processor 602. For example, an operating system can be stored in the memory 604 for execution by the processor 602. Where any component discussed herein is implemented in the form of software, any one of a number of programming languages can be employed such as, for example, C, C++, C#, Objective C, JAVA®, JAVASCRIPT®, Perl, PHP, VISUAL BASIC®, PYTHON®, RUBY, FLASH®, or other programming languages.

As discussed above, in various embodiments, the memory 604 stores software for execution by the processor 602. In this respect, the terms "executable" or "for execution" refer to software forms that can ultimately be run or executed by the processor 602, whether in source, object, machine, or other form. Examples of executable programs include, for example, a compiled program that can be translated into a machine code format and loaded into a random access portion of the memory 604 and executed by the processor 602, source code that can be expressed in an object code format and loaded into a random access portion of the memory 604 and executed by the processor 602, or source code that can be interpreted by another executable program to generate instructions in a random access portion of the memory 604 and executed by the processor 602, etc. An executable program can be stored in any portion or component of the memory 604 including, for example, a random access memory (RAM), read-only memory (ROM), magnetic or other hard disk drive, solid-state, semiconductor, or similar drive, universal serial bus (USB) flash drive, memory card, optical disc (e.g., compact disc (CD) or digital versatile disc (DVD)), floppy disk, magnetic tape, or other memory component.

In various embodiments, the memory 604 can include both volatile and nonvolatile memory and data storage components. Volatile components are those that do not retain data values upon loss of power. Nonvolatile components are those that retain data upon a loss of power. Thus, the memory 604 can include, for example, a RAM, ROM, magnetic or other hard disk drive, solid-state, semiconductor, or similar drive, USB flash drive, memory card accessed via a memory card reader, floppy disk accessed via an associated floppy disk drive, optical disc accessed via an optical disc drive, magnetic tape accessed via an appropriate tape drive, and/or other memory component, or any combination thereof. In addition, the RAM can include, for example, a static random access memory (SRAM), dynamic random access memory (DRAM), or magnetic random access memory (MRAM), and/or other similar memory device. The ROM can include, for example, a programmable read-only memory (PROM), erasable programmable read-only memory (EPROM), electrically erasable programmable read-only memory (EEPROM), or other similar memory device.

Also, the processor 602 can represent multiple processors 602 and/or multiple processor cores and the memory 604 can represent multiple memories that operate in parallel, respectively, or in combination. Thus, the local interface 606 can be an appropriate network or bus that facilitates communication between any two of the multiple processors 602, between any processor 602 and any of the memories 604, or between any two of the memories 604, etc. The local interface 606 can include additional systems designed to coordinate this communication, including, for example, a load balancer that performs load balancing. The processor 602 can be of electrical or of some other available construction.

As discussed above, the print engine 132, the cut engine 134, and the assembly engine 136 can be embodied, in part, by software or executable-code components for execution by general purpose hardware. Alternatively the same can be embodied in dedicated hardware or a combination of software, general, specific, and/or dedicated purpose hardware. If embodied in such hardware, each can be implemented as a circuit or state machine, for example, that employs any one of or a combination of a number of technologies. These technologies can include, but are not limited to, discrete logic circuits having logic gates for implementing various logic functions upon an application of one or more data signals, application specific integrated circuits (ASICs) having appropriate logic gates, field-programmable gate arrays (FPGAs), or other components, etc. Such technologies are generally well known by those skilled in the art and, consequently, are not described in detail herein.

The flowcharts or process diagrams of FIGS. 5A and 5B are representative of certain processes, functionality, and operations of embodiments discussed herein. Each block can represent one or a combination of steps or executions in a process. Alternatively or additionally, each block can represent a module, segment, or portion of code that includes program instructions to implement the specified logical function(s). The program instructions can be embodied in the form of source code that includes human-readable statements written in a programming language or machine code that includes numerical instructions recognizable by a suitable execution system such as the processor 602. The machine code can be converted from the source code, etc. Further, each block can represent, or be connected with, a circuit or a number of interconnected circuits to implement a certain logical function or process step.

Although the flowcharts or process diagrams of FIGS. 5A and 5B illustrate a specific order, it is understood that the order can differ from that which is depicted. For example, an order of execution of two or more blocks can be scrambled relative to the order shown. Also, two or more blocks shown in succession in FIGS. 5A and 5B can be executed concurrently or with partial concurrence. Further, in some embodiments, one or more of the blocks shown in FIGS. 5A and 5B can be skipped or omitted. In addition, any number of counters, state variables, warning semaphores, or messages might be added to the logical flow described herein, for purposes of enhanced utility, accounting, performance measurement, or providing troubleshooting aids, etc. It is understood that all such variations are within the scope of the present disclosure.

Also, any logic or application described herein, including the print engine 132, the cut engine 134, and the assembly engine 136 that are embodied, at least in part, by software or executable-code components, can be embodied or stored in any tangible or non-transitory computer-readable medium or device for execution by an instruction execution system such as a general purpose processor. In this sense, the logic can be embodied as, for example, software or executable-code components that can be fetched from the computer-readable medium and executed by the instruction execution system. Thus, the instruction execution system can be directed by execution of the instructions to perform certain processes such as those illustrated in FIGS. 5A and 5B. In the context of the present disclosure, a "computer-readable medium" can be any tangible medium that can contain, store, or maintain any logic, application, software, or executable-code component described herein for use by or in connection with an instruction execution system.

The computer-readable medium can include any physical media such as, for example, magnetic, optical, or semiconductor media. More specific examples of suitable computer-readable media include, but are not limited to, magnetic tapes, magnetic floppy diskettes, magnetic hard drives, memory cards, solid-state drives, USB flash drives, or optical discs. Also, the computer-readable medium can include a RAM including, for example, an SRAM, DRAM, or MRAM. In addition, the computer-readable medium can include a ROM, a PROM, an EPROM, an EEPROM, or other similar memory device.

Disjunctive language, such as the phrase "at least one of X, Y, or Z," unless specifically stated otherwise, is to be understood with the context as used in general to present that an item, term, etc., can be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications can be made to the above-described embodiment(s) without departing substantially from the spirit and principles of the disclosure. All such modifications and variations are intended to be included herein within the scope of this disclosure and protected by the following claims.

Therefore, at least the following is claimed:

1. A method, comprising:

capturing, by at least one computing device, an image of a textile sheet, the image comprising a fluorescent reflection of UV light off fluorescent ink printed on the textile sheet;

identifying, by the at least one computing device, the fluorescent reflection based at least in part on a wavelength-specific image processing technique to distinguish the fluorescent reflection from a non-fluorescent reflection in the image of the textile sheet;

generating, by the at least one computing device, cut control instructions to cut the textile sheet based at least in part on the fluorescent reflection; and instructing, by the at least one computing device, a textile cutter to cut the textile sheet based at least in part on the cut control instructions.

2. The method of claim 1, wherein the fluorescent ink comprises a washable protein-based fluorescent substance that reflects ultraviolet (UV) light in at least one visible wavelength.

3. The method of claim 1, further comprising instructing, by the at least one computing device, the textile cutter to illuminate a UV light source before capturing the image of the textile sheet.

4. The method of claim 1, wherein identifying the fluorescent reflection comprises identifying, by the at least one computing device, the fluorescent reflection based at least in part on a wavelength-specific intensity level thresholding technique.

5. The method of claim 1, wherein:

the image comprises a plurality of different colors of fluorescent reflections of UV light off the textile sheet; and the method further comprises identifying, by the at least one computing device, a plurality of different cutting tasks based at least in part on the different colors of fluorescent reflections of UV light.

6. The method of claim 5, wherein the plurality of different cutting tasks comprise a plurality of different cutting tasks using different cutting tools.

7. The method of claim 5, wherein the method further comprises determining, by the at least one computing device, a sequence for the plurality of different cutting tasks based at least in part on the different colors of fluorescent reflections of UV light.

8. The method of claim 1, further comprising:

developing, by the at least one computing device, a plurality of print features to print on a textile sheet for a textile product;

identifying, by the at least one computing device, a first print feature among the plurality of print features to print using a fluorescent ink; and identifying, by the at least one computing device, a second print feature among the plurality of print features to print using a non-fluorescent ink.

9. The method of claim 8, further comprising instructing, by the at least one computing device, a textile printer to print the first print feature onto the textile sheet using the fluorescent ink and to print the second print feature onto the textile sheet using the non-fluorescent ink.

10. The method of claim 1, further comprising:

generating, by the at least one computing device, a set of assembly notations to print on the textile sheet based at least in part on a plurality of assembly tasks;

selecting, by the at least one computing device, a first fluorescent ink to print a first assembly notation among the set of assembly notations and a second fluorescent ink to print a second assembly notation among the set of assembly notations; and instructing, by the at least one computing device, a textile printer to print the first assembly notation onto the textile sheet using the first fluorescent ink and to print the second assembly notation onto the textile sheet using the second fluorescent ink.

11. A system, comprising:

a textile printer comprising a plurality of ink tanks, a first of the plurality of ink tanks comprising a tank of fluorescent ink and a second of the plurality of ink tanks comprising a tank of non-fluorescent ink; and a textile cutter comprising an ultraviolet (UV) light source and an image sensor; and at least one computing device communicatively coupled to the textile printer and the textile cutter and configured to:

capture an image of a textile sheet, the image comprising a fluorescent reflection of UV light off the fluorescent ink printed on the textile sheet by the textile printer;

identify the fluorescent reflection based at least in part on a wavelength-specific image processing technique to distinguish the fluorescent reflection from a non-fluorescent reflection in the image of the textile sheet;

generate cut control instructions to cut the textile sheet based at least in part on the fluorescent reflection; and instruct a textile cutter to cut the textile sheet based at least in part on the cut control instructions.

12. The system of claim 11, wherein the fluorescent ink comprises a washable protein-based fluorescent substance that reflects ultraviolet (UV) light in at least one visible wavelength.

13. The system of claim 11, wherein the at least one computing device is further configured to instruct the textile cutter to illuminate the UV light source before capturing the image of the textile sheet.

14. The system of claim 11, wherein the at least one computing device is further configured to:

identify a first print feature to print on the textile sheet using the fluorescent ink;

identify a second print feature to print on the textile sheet using the non-fluorescent ink; and instruct the textile printer to print the first print feature onto the textile sheet using the fluorescent ink and to print the second print feature onto the textile sheet using the non-fluorescent ink.

15. A system, comprising:

a textile cutter comprising an ultraviolet (UV) light source and an image sensor; and at least one computing device communicatively coupled to the textile cutter and configured to:

capture an image of a textile sheet, the image comprising a fluorescent reflection of UV light off fluorescent ink printed on the textile sheet;

identify the fluorescent reflection based at least in part on a wavelength-specific image processing technique to distinguish the fluorescent reflection from a non-fluorescent reflection in the image of the textile sheet;

generate cut control instructions to cut the textile sheet based at least in part on the fluorescent reflection; and instruct a textile cutter to cut the textile sheet based at least in part on the cut control instructions.

16. The system of claim 15, wherein the fluorescent ink comprises a washable protein-based fluorescent substance that reflects ultraviolet (UV) light in at least one visible wavelength.

17. The system of claim 15, wherein the at least one computing device is further configured to instruct the textile cutter to illuminate a UV light source before capturing the image of the textile sheet.

18. The system of claim 15, wherein:

the image comprises a plurality of different colors of fluorescent reflections of UV light off the textile sheet; and the at least one computing device is further configured to identify a plurality of different cutting tasks based at least in part on the different colors of fluorescent reflections of UV light.

19. The system of claim 15, wherein the at least one computing device is further configured to:

compile a plurality of assembly tasks in an assembly scheme to assemble a textile product; and generate a set of assembly notations to print on the textile sheet based at least in part on the plurality of assembly tasks.

20. The system of claim 19, wherein the at least one computing device is further configured to:

select a first fluorescent ink to print a first assembly notation among the set of assembly notations and a second fluorescent ink to print a second assembly notation among the set of assembly notations; and instruct a textile printer to print the first assembly notation onto the textile sheet using the first fluorescent ink and to print the second assembly notation onto the textile sheet using the second fluorescent ink.

* * * * *